US005904412A

United States Patent [19]

Lammens

[11] Patent Number: 5,904,412

[45] Date of Patent: May 18, 1999

[54] DRAWER SLIDE MOUNTING BRACKET WITH GUSSETTED MOUNTING TAB

[75] Inventor: Arthur E. Lammens, Fullerton, Calif.

[73] Assignee: Accuride International, Inc., Santa Fe Springs, Calif.

[21] Appl. No.: 08/841,515

[22] Filed: Apr. 23, 1997

[51] Int. Cl.[6] ..... A47B 88/00

[52] U.S. Cl. ..... 312/334.7; 312/334.1

[58] Field of Search ..... 312/334.8, 348.1, 312/348.2, 334.1, 334.4, 334.7, 330.1; 384/22, 18; 248/224.61, 224.8, 222.1; 16/94 R

[56] References Cited

U.S. PATENT DOCUMENTS

| | | | |
|---|---|---|---|
| 3,015,532 | 1/1962 | Wilson | 312/334.41 |
| 3,631,572 | 1/1972 | Lange | 248/224.61 |
| 3,771,849 | 11/1973 | Barber | 384/18 |
| 3,778,120 | 12/1973 | Hagen et al. . | |
| 3,937,531 | 2/1976 | Hagen et al. . | |
| 3,966,273 | 6/1976 | Hagen et al. . | |
| 4,141,525 | 2/1979 | Miller | 312/334.5 |
| 4,181,279 | 1/1980 | Perrault et al. | 248/224.8 |
| 4,834,555 | 5/1989 | Grass | 384/22 |
| 4,838,627 | 6/1989 | Macias | 312/334.7 |
| 5,823,648 | 10/1998 | Domenig | 312/334.7 |

FOREIGN PATENT DOCUMENTS

| | | | |
|---|---|---|---|
| 537567 | 2/1957 | Canada | 16/94 R |

OTHER PUBLICATIONS

Accuride International Inc., Slides for Residential and Contract Furniture and Cabinetry, p. 4, 1994.

Accuride International Inc., Model C 214 Data Sheet, 1992.

Accuride International Inc., Models 3832A, 3834A, 3837A Data Sheet, 1994.

Accuride International Inc., A Complete Guide to the 3832 Family of Full Extension Drawer Slides, 4 pages., 1994.

*Primary Examiner*—Peter M. Cuomo
*Assistant Examiner*—Gerald A. Anderson
*Attorney, Agent, or Firm*—Christie, Parker & Hale, LLP

[57] ABSTRACT

A drawer slide mounting bracket with a mounting tab and horizontal flanges extending from vertical arms. The mounting tab is inserted into an aperture in a vertical web of a drawer slide member and the horizontal flanges engage the slide member to securely attach the mounting bracket to the drawer slide member. The mounting tab is provided with a gusset to increase the strength of the mounting tab and to decrease the range of movement of the mounting tab in the aperture.

13 Claims, 3 Drawing Sheets

DRAWER SLIDE MOUNTING BRACKET WITH GUSSETTED MOUNTING TAB

FIELD OF THE INVENTION

The present invention relates to drawer slides and drawer slide accessory hardware. The invention specifically relates to an improved drawer slide and mounting bracket for mounting a drawer slide to a cabinet or enclosure.

BACKGROUND OF THE INVENTION

Telescopic slides for file drawers and the like are often desirable for use in cabinets and other rack mounted applications. Such slides permit easy access to the interior of the drawer. The slides maintain the drawer in a horizontal position regardless of how far the drawer is withdrawn from the cabinet. A typical drawer slide has two or three slide members slidably connected by sets of ball bearings held by retainers riding in raceways formed on the slide members. Two element telescopic slides normally include an outer slide member and an inner slide member. For purposes of exposition, the outer slide member is connected to the cabinet or enclosure, although it is recognized that the inner slide member may instead be so connected. When the outer slide member is connected to the cabinet or enclosure, the slide member affixed to the drawer is the inner slide member. A three element telescopic slide will additionally normally include an intermediate slide member slidably connected to and between the outer and inner slide members.

A typical drawer will often have two slides securing the drawer to the cabinet or enclosure, with slides attached to each of the outside of the vertical side walls of the drawer. The slides may be attached to the cabinet or enclosure by a variety of methods. The outer slide member may have screw holes in its vertical web thereby allowing attachment of the outer slide member to the cabinet or enclosure through the use of a screw. A flange may also be integrally formed on the outer slide member, the flange having screw holes for a similar method of attachment. A mounting bracket may also be welded to the outer slide member.

The foregoing methods of mounting a outer slide member to a cabinet or enclosure are not free of problems. Requiring that a screw be placed through the vertical web may provide difficulties in accessing the screw hole when the slide is not extended. With the slide extended such difficulty may be alleviated, but the extended slide may be inadvertently damaged or possibly cause injury to persons due to its projecting nature. The screw protruding inward from the slide member may also interfere with the motion of other slide members. Forming an integral flange from the outer slide member also poses difficulties. Manufacturing costs may increase due to the requirement of additional operations being performed on the outer slide member, as well as due to extra material waste. Welding mounting brackets to the outer slide member also poses problems as the mounting brackets may not be required in all applications and the mounting brackets cannot be repositioned along the length of the outer slide member.

Thus, there is a need for a mounting apparatus for a drawer slide that does not require access through the web of the slide, does not require additional manufacturing operations to be performed on the outer slide member, and is positionable along the length of the outer slide member.

SUMMARY OF THE INVENTION

The present invention provides a drawer slide member and mounting bracket. The drawer slide member has a vertical web with an aperture in the web adapted to receive a tab extending from a mounting bracket. The mounting bracket has extending arms with flanges that engage the outside surfaces of bearing raceways of a slide member. Providing the mounting tab with a gusset strengthens the mounting tab and allows for more secure placement of the mounting bracket. Thus, a repositionable and replaceable mounting means for a drawer slide is provided.

Many of the attendant features of this invention will be more readily appreciated as the same becomes better understood by reference to the following detailed description and considered in connection with the accompanying drawings in which like reference symbols designate like parts throughout.

DETAILED DESCRIPTION OF THE INVENTION

Figure 1:
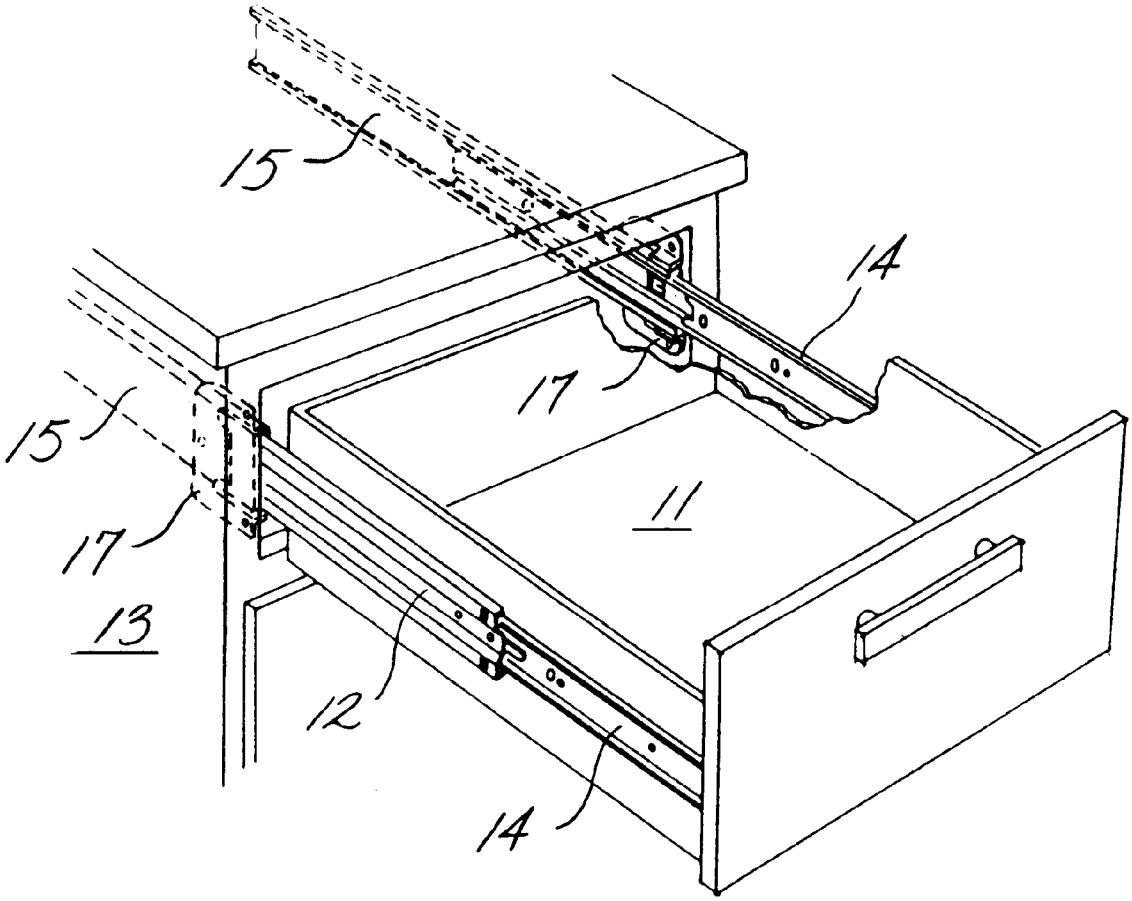
FIG. 1 is a perspective view of a cabinet with a drawer coupled to the cabinet by a drawer slide with U-channel bearing raceways and mounting bracket of the present invention.

A drawer slide and mounting bracket of the present invention are shown in FIG. 1. As viewed in FIG. 1, a drawer 11 is mounted to a cabinet 13 via drawer slides and mounting brackets 17. The drawer slides are comprised of an inner slide member 14, an intermediate slide member 12, and an outer slide member 15. The outer slide member 15 is secured to the cabinet with the use of the mounting brackets 17. The outer slide member 15 has U-channel bearing raceways. The inner slide member 14 is secured to the drawer 11. The inner, intermediate, and outer slide members 14, 12, 15 are slidably connected.

Figure 2:
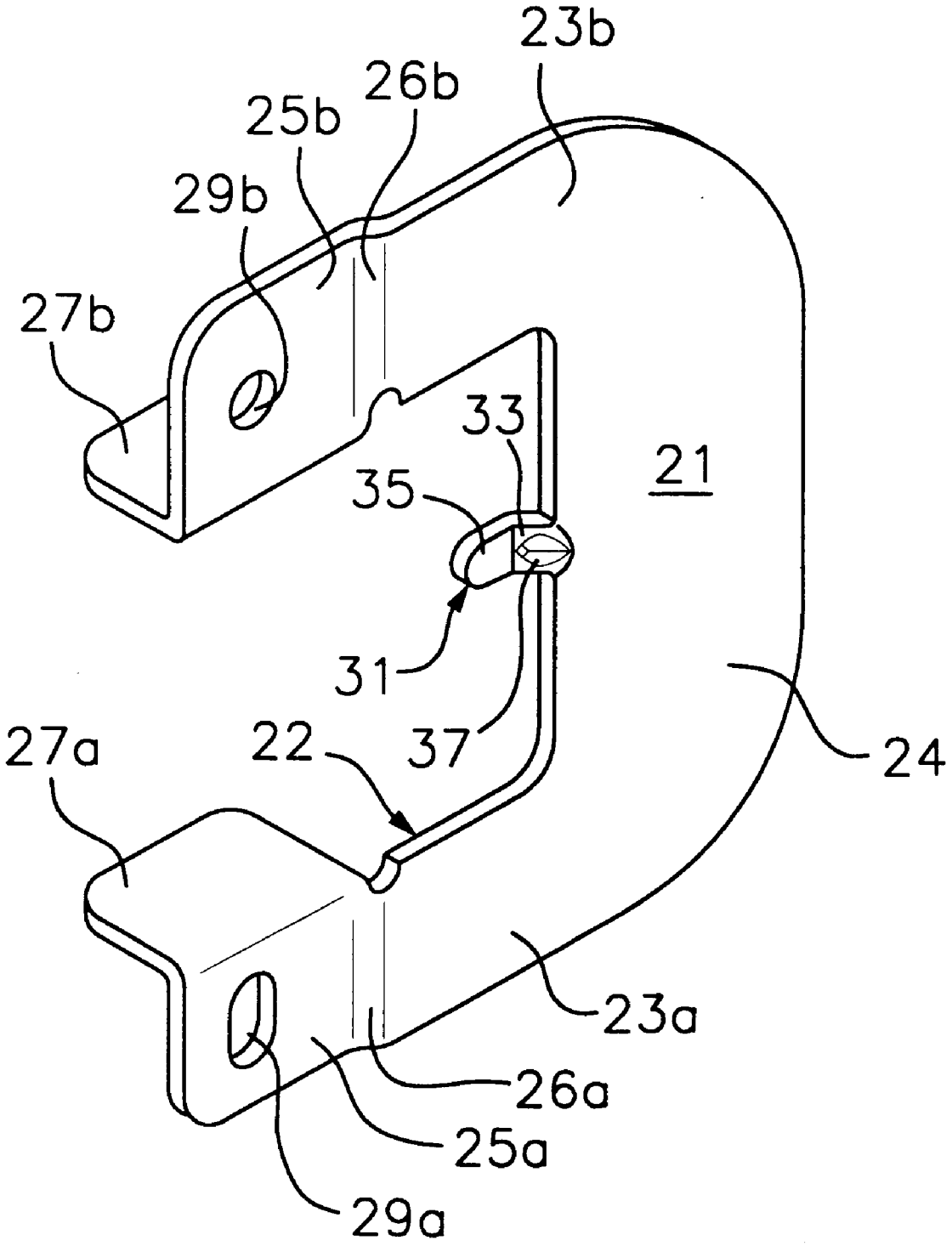
FIG. 2 is a perspective view of the mounting bracket of FIG. 1.

Details of the mounting bracket 17 can be seen in FIG. 2. The mounting bracket 17 is substantially planar and C-shaped. The mounting bracket has a flat body portion 21. The body portion 21 is substantially rectangular in shape. For convenience, the substantially flat planar mounting bracket 17 will be described as having a drawer surface 22 and a cabinet surface 24. The drawer surface will be the surface facing in the direction of the drawer, and thus a slide member, when the mounting bracket is attached to a cabinet and a slide member. The cabinet surface will be the surface facing in the direction of a cabinet when a slide member is secured to the cabinet by the mounting bracket 17. Substantially flat vertical arms 23*a,b* extend in the same direction from the upper and lower margins of the body portion 21. The vertical arms 23*a,b*, are substantially in the same plane as the body portion 21. The vertical arms 23*a,b* and the body portion 21, therefore, substantially form the shape of a C, with the inner part of the C being of a rectangular shape. The vertical arms 23*a,b* have a slightjog 26*a,b*, or coplanar translation, in the cabinet direction near the ends of the vertical arms 23*a,b*. Thus, the endmost portions 25*a,b* of the vertical arms 23*a,b* do not lie in the same plane as the previously described portions of the mounting bracket 17, but instead lie in a plane parallel and slightly offset from the plane of the body portion 21. The endmost portions 25*a,b* each have a screw hole 29*a,b* to allow attachment of the mounting bracket 17 to a cabinet. One of the screw holes 29*a* is larger than the other screw hole 29*b* to provide for some slight repositioning of the mounting bracket 17 during installation. The screw holes 29 may be made the same dimension if desired. The jogs 26*a,b* in the vertical arms 23*a,b* serve as a registration surface when attaching the mounting bracket 17 to a cabinet. The use of a registration surface is particularly convenient when the cabinet is of the face frame type. A face frame cabinet generally has thin side walls not suitable for the mounting of drawer slides supporting heavily loaded drawers. Instead a face frame cabinet will have a frame formed with sturdy support members to which both the drawer slides and the side walls of the cabinet are attached. Placing the jogs 26*a,b* in the vertical arms 23*a,b* against an edge of such a support member positions the screw holes 29 over the support member and makes attachment of the mounting bracket 17 to the support member a more easily accomplished task. The vertical arms 23*a,b* are able to flex or slightly bend with respect to the flat body portion 21. This flexing or bending ability is important because cabinet dimensions are not always exact, particularly in wood cabinets.

Extending from the endmost portions 25*a,b* of the arms 23*a,b* on the inside of the C-shape are horizontal flanges 27*a,b*. The horizontal flanges 27*a,b* extend in the drawer direction. The distance between the horizontal flanges 27*a,b* is such that the horizontal flanges 27*a,b* engage the uppermost and lowermost portions of an outer slide member. The horizontal flanges 27*a,b* serve to maintain the position of the mounting bracket 17 with respect to the outer slide member, particularly when attaching the mounting bracket 17 and drawer slide to a cabinet.

A mounting tab 31 also extends from the mounting bracket 17. The mounting tab 31 extends from the body portion 21 approximately midway between, and in the same general direction, as the vertical arms 23*a,b*. The mounting tab 31, however, immediately has a jog in the drawer direction. That is the mounting tab 31 has an angled portion 33 extending from the body portion 21 at an approximately 60° angle with respect to the body portion 21 in the drawer direction. The outer portion 35 of the mounting tab 31 extends from the end of the angled portion 33 and parallel to the vertical arms 23*a,b*.

Additionally, the angled portion 33 is given a slight gusset 37. The gusset is formed by placing an indentation in the middle of the angled portion 33, with the indentation forming a nub with a spine on the drawer side of the angled portion 33. The nub allows the mounting tab 31 to be more securely positioned in an aperture on a drawer slide. The nub is also believed to strengthen the mounting tab 31 and thereby prevent bending of the mounting tab 31. To increase the ease of placing the mounting tab 31 in an aperture the tip of the outer portion 35 is slightly rounded.

Figure 3:
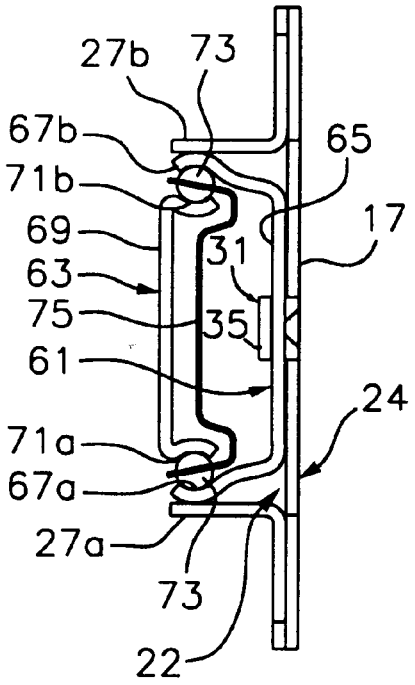
FIG. 3 is an end view of a drawer slide with arcuate concave inward facing bearing raceways and the mounting bracket of the present invention and, FIG. 4 is a perspective view of the drawer slide and mounting bracket of FIG.3.

FIG. 3 shows an end view of the mounting bracket 17 attached to a drawer slide. The drawer slide is of the two slide member type, with an outer slide member 61 and an inner slide member 63. The outer slide member 61 has a vertical web 65. Extending from the upper and lower margins of the web 65 of the outer slide member 61 are arcuate concave inward facing ball bearing raceways 67*a,b*. The raceways could also be U-channel raceways, as are the raceways of the outer slide member 15 of FIG. 1. U-channel raceways have generally flat horizontal arms extending from the upper and lower margins of the vertical web, with vertical lips extending vertically inward from the ends of the horizontal arms. The ball bearings ride on the flat horizontal arms and are constrained laterally by the vertical web and the vertical lips. The inner slide member 63 also has a vertical web 69 with arcuate concave outward facing ball bearing raceways 71*a,b*. Ball bearings 73 in rolling engagement with both the inward facing raceways 67*a,b* and outward facing raceways 71*a,b* slidably connect the inner slide member 63 and outer slide member 61.

When the mounting bracket 17 is attached to the outer slide member, the drawer side of the body portion 21 of the mounting bracket 17 is placed adjacent the outer slide member 61. The mounting tab 31 is placed through an aperture 45 (shown in FIG. 4) in the web 65 of the outer slide member 61, and the outer portion 35 of the mounting tab 17 is largely in contact with the drawer side of the web 65 of the outer slide member 61. The horizontal flanges 27*a,b* are in contact with the outer surface of the ball bearing raceways 67*a,b* of the outer slide member 61. In the embodiment shown, the distance between the horizontal flanges 27*a,b* is just slightly less than the distance between the outer surfaces of the ball bearing raceways 67*a,b*. The horizontal flanges 27*a,b* therefore are slightly deflected in the outward direction by the raceways 67*a,b*, thereby causing the horizontal flanges 27*a,b* to frictionally engage the raceways 67*a,b*. The frictional engagement of the bearing raceways by the horizontal flanges helps maintain the position of the mounting bracket with respect to the drawer slide, particularly when the jog 26*a,b* is being used to register the position of the mounting bracket with respect to a cabinet support member. Even without the frictional engagement the horizontal flanges 27*a,b* act to maintain the position of the mounting bracket, although not to as great an extent.

The mounting tab 31 does not extend forward from the body portion 21 a sufficient distance such that when the mounting bracket 17 is placed perpendicular to the outer slide member with the mounting tab 31 inserted in the aperture 45 of the outer slide member 61 that the mounting tab 31 contacts a bearing retainer 75 which retains the bearings 73. However, a longer mounting tab 31 could be used if apertures are also placed in the web of the bearing retainer. A similar concept applies in a three-member drawer slide, except the aperture would be placed in the intermediate slide member.

Figure 4:
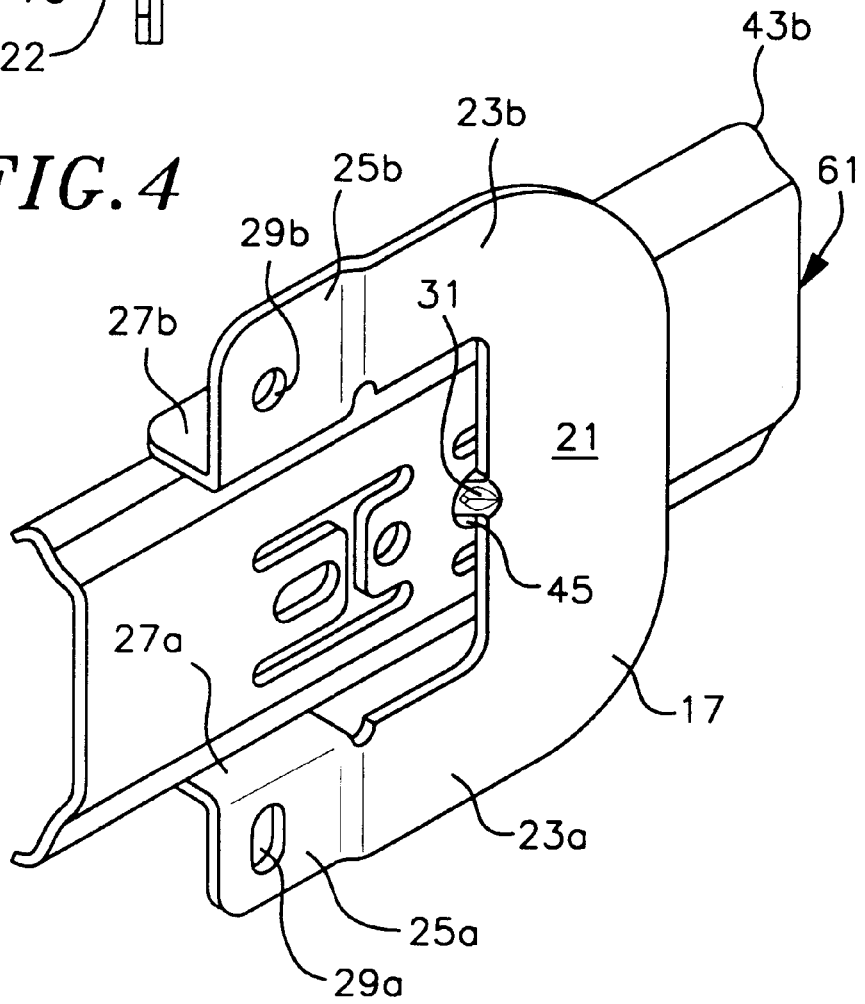

In FIG. 4 the mounting bracket 17 is shown attached to the outer slide member 61. As the drawer slide members are considered to move longitudinally with respect to the other slide members, the mounting tab 31 securely positions the mounting bracket 17 with respect to the outer slide member 61 in the longitudinal direction. Any movement between the outer slide member 61 and the mounting bracket 17 in the longitudinal direction is further reduced by the nub or spine formed by the gusset 37 on the angled portion 33 of the mounting bracket 17. Movement of the mounting bracket 17 with respect to the outer slide member 61 is further restricted by the horizontal flanges 27*a,b*. As can be seen in FIG. 3, the vertical distance between the horizontal flanges 27*a,b* is no greater than the vertical distance between the top and bottom of the raceways outer slide member 61. Therefore, when the mounting bracket 17 is attached to the outer slide member, the horizontal flanges 27*a,b* are under tension, frictionally contacting the outer slide member 61 and thereby further restricting movement of the mounting bracket 17 with respect to the outer slide member 61. Even without such frictional contact, as previously mentioned, the horizontal flanges 27*a,b* still serve to maintain the position of the mounting bracket 17 with respect to the outer slide member to a certain extent. The flat planar body portion 21 also prevents the mounting bracket 17 from pivoting with respect to the outer slide member 61.

Although this invention has been described in a certain specific embodiment, many additional modifications and variations will be apparent to those skilled in the art. It is therefore to be understood that this invention may be practiced otherwise and as specifically described. For example, additional mounting apertures may be placed in the vertical arms or the horizontal flanges may be shaped with a contour to provide more secure engagement with the outer slide member. Thus, the present embodiments of the invention should be considered in all aspects as illustrative and not restrictive, the scope of the invention to be indicated by the appended claims rather than the foregoing description.

I claim:

1. A drawer slide member and mounting bracket comprising:

a mounting bracket comprising:
a substantially flat body;

two substantially flat arms extending from the body, the arms having endmost portions, with the arms being substantially in a plane defined by the body;

each arm having a flange, the flanges being spaced apart a first distance; and a tab extending from the body; and
a drawer slide member comprising:
a web with an aperture in the web adapted to receive the tab with the body adjacent the web when the aperture receives the tab; and two raceway arms extending from the web, the raceway arms being spaced apart a second distance, the first distance being less than the second distance, such that the flanges are deflected by the raceway arms so as to frictionally engage the raceway arms when the aperture receives the tab.

2. The drawer slide member and mounting bracket of claim 1 wherein the body has opposing margins, and the arms extend in the same direction from the body, with a first of the arms extending from a first of the opposing margins of the body and a second of the arms extending from a second of the opposing margins of the body.

3. The drawer slide member and mounting bracket of claim 2 wherein the two arms have a coplanar transition near the endmost portions of the arms.

4. The drawer slide member and mounting bracket of claim 3 wherein the tab has an angled portion extending from the body in a plane other than the plane defined by the body and an outer portion extending from the angled portion in a plane substantially parallel to the plane of the body.

5. The drawer slide member and mounting bracket of claim 4 wherein the angled portion of the tab has a gusset.

6. The drawer slide member and mounting bracket of claim 5 wherein the raceway arms form arcuate inward facing concave ball bearing raceways.

7. The drawer slide member and mounting bracket of claim 5 wherein the raceway arms form flat U-channel inward facing ball bearing raceways.

8. A drawer slide and mounting bracket comprising:

an outer slide member having a web with an aperture, and first and second raceway arms forming first and second bearing raceways extending from opposing margins of the web;

an inner slide member having a web, and third and fourth raceway arms forming third and fourth bearing raceways extending from opposing margins of the web;

a first plurality of bearings in rolling engagement with the first bearing raceways of the outer slide member and the third bearing raceways of the inner slide member;

a second plurality of bearings in rolling engagement with the second bearing raceway of the outer slide member and the fourth bearing raceways of the inner slide member; and a planar body portion having opposing margins, the planar body portion being adjacent the web with the aperture;

flexible arms extending from the opposing margins of the body portion, the arms being substantially in a plane defined by the body portion, the arms also having endmost portions having flanges in engagement with the first and second arm of the outer slide member, the endmost portions each having a screw hole adapted to allow attachment of the mounting bracket to a cabinet; and a tab extending from the body portion, the tab being positioned in the aperture of the web of the outer slide member.

9. The drawer slide and mounting bracket of claim 8 wherein the tab has an angled portion extending from the body portion in a plane other than the plane defined by the body and an outer portion extending from the angled portion in a plane substantially parallel to the plane of the body portion.

10. The drawer slide member and mounting bracket of claim 9 wherein the angled portion of the tab has a gusset.

11. The drawer slide and mounting bracket of claim 10 wherein the distance between the flanges is less than the distance between the first and second raceway arms so that the flanges are in frictional engagement with the first and second raceway arms.

12. The drawer slide and mounting bracket of claim 11 wherein the first and second bearing raceways form arcuate inward facing concave ball bearing raceways.

13. The drawer slide and mounting bracket of claim 11 wherein the first and second bearing raceways form flat U-channel inward facing ball bearing raceways.

* * * * *